US008999518B2

(12) United States Patent
Vescera

(10) Patent No.: US 8,999,518 B2
(45) **Date of Patent: *Apr. 7, 2015**

(54) HIERARCHICAL COMPOSITE MATERIAL

(75) Inventor: Francesco Vescera, Vaux-Borset (BE)

(73) Assignee: Magotteaux International S.A., Vaux-Sous-Chevremont (BE)

( * ) Notice: Subject to any disclaimer, the term of this patent is extended or adjusted under 35 U.S.C. 154(b) by 1052 days.

This patent is subject to a terminal disclaimer.

(21) Appl. No.: 13/119,688

(22) PCT Filed: Aug. 26, 2009

(86) PCT No.: PCT/EP2009/060980

§ 371 (c)(1),
(2), (4) Date: May 31, 2011

(87) PCT Pub. No.: WO2010/031662

PCT Pub. Date: Mar. 25, 2010

(65) Prior Publication Data

US 2011/0229715 A1 Sep. 22, 2011

(30) Foreign Application Priority Data

Sep. 19, 2008 (BE) ..... 2008/0521

(51) Int. Cl.

| | |
|---|---|
| ***B32B 15/04*** | (2006.01) |
| ***B32B 19/00*** | (2006.01) |
| ***B22F 1/00*** | (2006.01) |
| ***C22C 33/02*** | (2006.01) |
| ***C22C 1/10*** | (2006.01) |

(Continued)

(52) U.S. Cl.

CPC ..... *C22C 33/0228* (2013.01); *C22C 1/1068* (2013.01); *B22D 19/14* (2013.01); *C22C 37/00* (2013.01); *C22C 38/00* (2013.01); *B22F 2999/00* (2013.01); *C22C 2001/1052* (2013.01)

(58) Field of Classification Search

None

See application file for complete search history.

(56) References Cited

U.S. PATENT DOCUMENTS

| | | | |
|---|---|---|---|
| 4,909,842 | A | 3/1990 | Dunmead et al. |
| 5,081,774 | A | 1/1992 | Kuwano |

(Continued)

FOREIGN PATENT DOCUMENTS

| | | | |
|---|---|---|---|
| EP | 0 550 725 | B1 | 4/1997 |
| EP | 0852978 | A1 | 7/1998 |

(Continued)

OTHER PUBLICATIONS

Geometry definition, 2014, http://www.merriam-webster.com/dictionary/geometry.*

(Continued)

*Primary Examiner* — David Sample
*Assistant Examiner* — Seth Dumbris
(74) *Attorney, Agent, or Firm* — Reinhart Boerner Van Deuren P.C.

(57) ABSTRACT

The present invention discloses a hierarchical composite material comprising a ferrous alloy reinforced with titanium carbides according to a defined geometry, in which said reinforced portion comprises an alternating macro-microstructure of millimetric areas concentrated with micrometric globular particles of titanium carbide separated by millimetric areas essentially free of micrometric globular particles of titanium carbide, said areas concentrated with micrometric globular particles of titanium carbide forming a microstructure in which the micrometric interstices between said globular particles are also filled by said ferrous alloy.

14 Claims, 9 Drawing Sheets

(51) Int. Cl.

| | |
|---|---|
| ***B22D 19/14*** | (2006.01) |
| ***C22C 37/00*** | (2006.01) |
| ***C22C 38/00*** | (2006.01) |

(56) References Cited

U.S. PATENT DOCUMENTS

| | | | | |
|---|---|---|---|---|
| 5,337,801 | A | 8/1994 | Materkowski | |
| 5,720,830 | A | 2/1998 | Wragg et al. | |
| 5,755,299 | A * | 5/1998 | Langford et al. | 175/375 |
| 6,099,664 | A | 8/2000 | Davies et al. | |
| 6,451,249 | B1 | 9/2002 | Koizumi et al. | |
| 8,602,340 | B2 * | 12/2013 | Berton | 241/293 |
| 8,646,192 | B2 * | 2/2014 | Berton | 37/460 |
| 8,651,407 | B2 * | 2/2014 | Berton | 241/194 |
| 2004/0110021 | A1 * | 6/2004 | Seth et al. | 428/553 |
| 2005/0045252 | A1 | 3/2005 | Yamasaki et al. | |
| 2005/0072545 | A1 * | 4/2005 | Poncin et al. | 164/97 |
| 2007/0099014 | A1 * | 5/2007 | McCullough et al. | 428/469 |

FOREIGN PATENT DOCUMENTS

| | | |
|---|---|---|
| EP | 1450973 | 7/2006 |
| GB | 2 257 985 A | 1/1993 |
| WO | WO 93/03192 A1 | 2/1993 |
| WO | WO 02/053316 A1 | 7/2002 |

OTHER PUBLICATIONS

K. Das, A Review on the various synthesis routes of TiC reinforced ferrous based composites, online publication, 2002, 11 pages, pp. 3881-3892, Journal of Materials Science 37 (2002) 3881-3892.

* cited by examiner

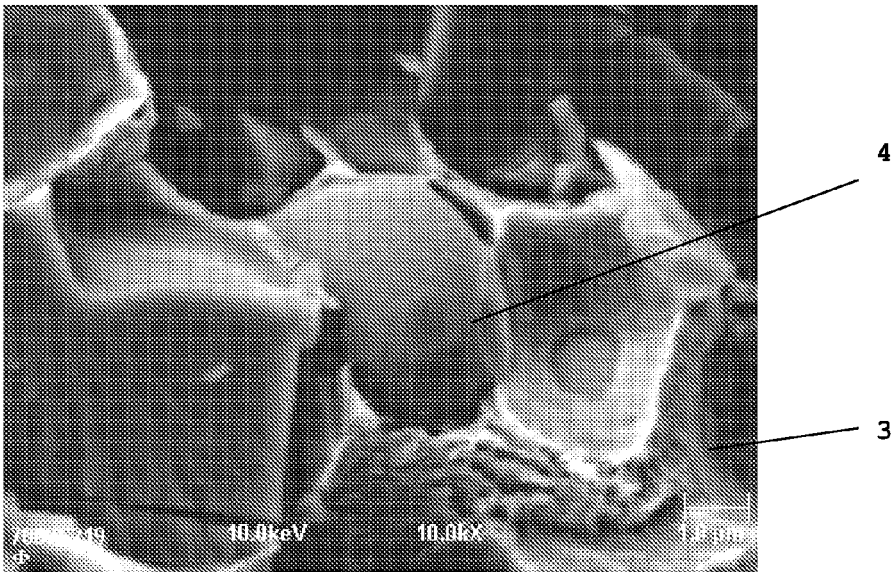
Fig.8
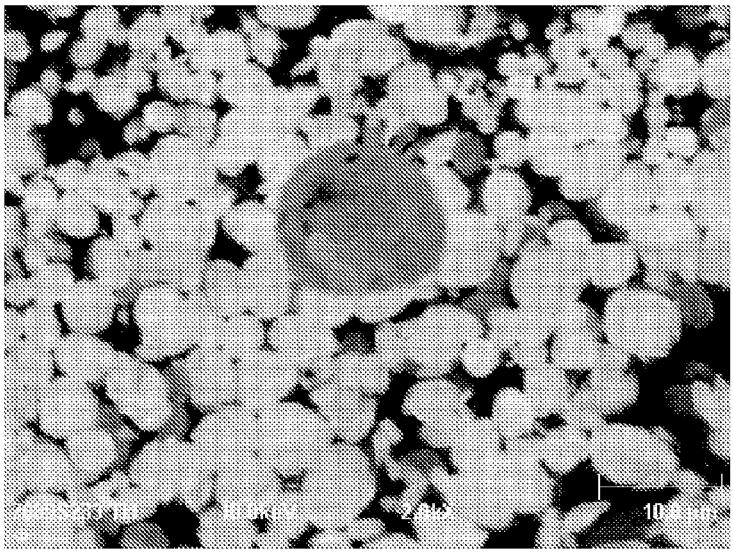
Fig.9 (Ti)

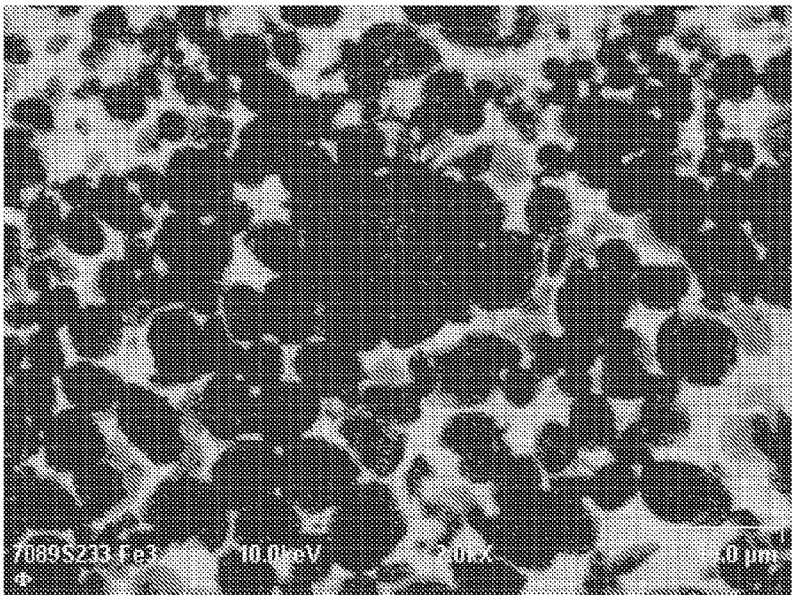
Fig.10 (Fe)
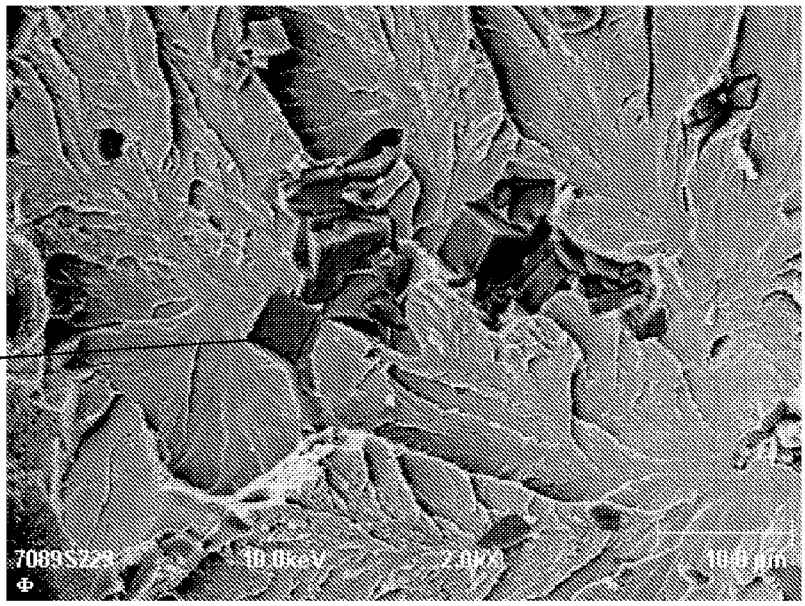
Fig.11

HIERARCHICAL COMPOSITE MATERIAL

FIELD OF THE INVENTION

The present invention relates to a hierarchical composite material having an improved resistance to the combined wear/impact stress. The composite comprises a metal matrix in cast iron or steel, reinforced by a particular structure of titanium carbide.

DESCRIPTION

Hierarchical composites are a well-known family in materials science. For composite wear parts made in foundries, the reinforcement elements must be present over a sufficient thickness in order to withstand significant and simultaneous stresses in terms of wear and impact.

The composite wear parts reinforced by titanium carbide are well known to the person skilled in the art and their making via different access ways is described in the summary article *<<A review on the various synthesis routes of TiC reinforced ferrous based composites>>* published in Journal of Material Science 37 (2002), pp. 3881-3892.

The composite wear parts reinforced by titanium carbide generated in situ are one of the possibilities mentioned in this article at point 2.4. The wear parts in this case are nevertheless made by exclusively using powders within the scope of a high temperature self-propagating synthesis (SHS), wherein titanium reacts with carbon in an exothermic way in order to form titanium carbide within a matrix based on a ferrous alloy, also introduced as a powder. This type of synthesis allows to obtain micrometric globular titanium carbide dispersed homogeneously within a matrix of a ferrous alloy (FIG. 12A (c)). The article also gives a very good description of the difficulty in controlling such a synthesis reaction.

Document EP 1 450 973 (Poncin) describes a wear part reinforcement made by placing in the mold intended to receive the cast metal, an insert consisting of a mixture of powders which react with each other thanks to the heat provided by the metal during the high temperature casting (>1, 400° C.). The reaction between the powders is initiated by the heat of the cast metal. The powders of the reactive insert, after reaction of the SHS type, will generate a porous cluster (conglomerate) of hard ceramic particles formed in situ; this porous cluster, once it is formed and still at a very high temperature, will be immediately infiltrated by the cast metal. The reaction between the powders is exothermic and self-propagating, which allows a carbide synthesis in the mold at a high temperature and considerably increases the wettability of the porous cluster with regard to the infiltration metal. This technology, although much more economical than powder metallurgy, still remains quite expensive.

Document WO 02/053316 (Lintunen) notably discloses a composite part obtained by SHS reaction between titanium and carbon in the presence of binders, which allows the filling of the pores of the skeletton formed by the titanium carbide. The parts are made from powders compressed in a mold. The hot mass obtained after SHS reaction remains plastic and is compressed into its definitive form. Ignition of the reaction is however not achieved by the heat of any outer cast metal and moreover there is not any phenomenon of infiltration by an outer cast metal either. Document EP 0 852 978 A1 and document U.S. Pat. No. 5,256,368 disclose an analogous technique related to the use of pressure or of a pressurized reaction in order to result in the reinforced part.

Document GB 2,257,985 (Davies) discloses a method for making a titanium carbide reinforced alloy by powder metallurgy. The latter appears as microscopic globular particles with a size of less than 10 μm dispersed within the porous metal matrix. The reaction conditions are selected so as to propagate an SHS reaction front in the part to be made. The reaction is ignited with a burner and there is no infiltration by an outer cast metal.

Document U.S. Pat. No. 6,099,664 (Davies) discloses a composite part comprising titanium boride and possibly titanium carbide. The mixture of powders comprising eutectic ferrotitanium, is heated with a burner so as to form exothermic reactions of boron and titanium. Here, a reaction front propagates through the part.

Document U.S. Pat. No. 6,451,249 B1 discloses a reinforced composite part comprising a ceramic skeleton with possibly carbides which are bound together by a metal matrix as a binder and which contains a thermite capable of reacting according to an SHS reaction for producing the melting heat required for agglomerating ceramic granules.

Documents WO 93/03192 and U.S. Pat. No. 4,909,842 also disclose a method for making an alloy comprising particles of titanium carbide finely dispersed within a metal matrix. This is here again a powder metallurgy technique and not an infiltration technique by casting in a foundry.

Document US 2005/045252 discloses a hierarchical composite with a periodic and three-dimensional hierarchical structure of hard and ductile metal phases arranged in strips.

Other techniques are also well-known to the person skilled in the art, such as for example adding hard particles into the liquid metal, in the melting furnace, or further recharging or reinforcement techniques with inserts. All these techniques however have various drawbacks which do not allow to make a hierarchical composite reinforced with titanium carbide with practically no limitation on thickness and having a good resistance to impacts and flaking and this in a highly economical way.

AIMS OF THE INVENTION

The present invention proposes to find a remedy for the drawbacks of the state of the art and discloses a hierarchical composite material having an improved resistance to wear, while maintaining a good resistance to impacts. This property is obtained by a particular reinforcement structure assuming the form of a macro-microstructure comprising discrete millimetric areas concentrated with micrometric globular particles of titanium carbide.

The present invention also proposes a hierarchical composite material comprising a particular titanium carbide structure obtained with a particular method.

The present invention further proposes a method for obtaining a hierarchical composite material comprising a particular titanium carbide structure.

SUMMARY OF THE INVENTION

The present invention discloses a hierarchical composite material comprising a ferrous alloy reinforced with titanium carbide according to a defined geometry, in which said reinforced portion comprises an alternating macro-microstructure of millimetric areas concentrated with micrometric globular particles of titanium carbide separated by millimetric areas essentially free of micrometric globular particles of titanium carbide, said areas concentrated with micrometric globular particles of titanium carbide forming a microstructure in which the micrometric interstices between said globular particles are also filled by said ferrous alloy.

According to particular embodiments of the invention, the hierarchical composite material comprises at least one or one suitable combination of the following features:

said concentrated millimetric areas have a titanium carbide concentration of more than 36.9% by volume;

said reinforced portion has a global titanium carbide content between 16.6 and 50.5% by volume;

the micrometric globular particles of titanium carbide have a size of less than 50 μm;

the major portion of the micrometric globular particles of titanium carbide has a size of less than 20 μm;

said areas concentrated with globular particles of titanium carbide comprise 36.9 to 72.2% by volume of titanium carbide;

said millimetric areas concentrated with titanium carbide have a size varying from 1 to 12 mm;

said millimetric areas concentrated with titanium carbide have a size varying from 1 to 6 mm;

said areas concentrated with titanium carbide have a size varying from 1.4 to 4 mm;

said composite is a wear part.

The present invention also discloses a method for manufacturing the hierarchical composite material according to any of claims 1 to 10 comprising the following steps:

providing a mold comprising the imprint of the hierarchical composite material with a predefined reinforcement geometry;

introducing into the portion of the imprint intended to form the reinforced portion a mixture of compacted powders comprising carbon and titanium in the form of millimetric granules precursor of titanium carbide;

casting a ferrous alloy into the mold, the heat of said casting triggering an exothermic self-propagating high temperature synthesis (SHS) of titanium carbide within said precursor granules;

forming, within the reinforced portion of the hierarchical composite material, an alternating macro-microstructure of millimetric areas concentrated with micrometric globular particles of titanium carbide at the location of said precursor granules, said areas being separated from each other by millimetric areas essentially free of micrometric globular particles of titanium carbide, said globular particles being also separated within said millimetric areas concentrated with titanium carbide through micrometric interstices;

infiltration of the millimetric and micrometric interstices by said high temperature cast ferrous alloy, following the formation of microscopic globular particles of titanium carbide.

According to particular embodiments of the invention, the method comprises at least one or one suitable combination of the following features:

the mixture of compacted powders of titanium and carbon comprises a powder of a ferrous alloy;

said carbon is graphite.

The present invention also discloses a hierarchical composite material obtained according to the method of any of claims 11 to 13.

Finally, the present invention also discloses a tool or a machine comprising a hierarchical composite material according to any of claims 1 to 10 or according to claim 14.

SHORT DESCRIPTION OF THE FIGURES

FIG. 1 shows a diagram of the reinforcement macro-microstructure within a matrix of steel or cast iron forming the composite. The pale phase illustrates the metal matrix and the dark phase, areas concentrated with globular titanium carbide. The photograph is taken at a small magnification with an optical microscope on a non-etched polished surface.

FIG. 2 illustrates the limit of an area concentrated with globular titanium carbide towards an area globally free of globular titanium carbide at a bigger magnification. The continuity of the metal matrix over the whole part is also noted. The space between the micrometric particles of titanium carbide (micrometric interstices or pores) is also infiltrated by the cast metal (steel or cast iron). The photograph is taken with a small magnification with an optical microscope on a non-etched polished surface.

FIGS. 3*a*-3*h* illustrate the method for manufacturing a hierarchical composite according to the invention.

step 3*a* shows the device for mixing the titanium and carbon powders;

step 3*b* shows the compaction of the powders between two rolls followed by crushing and sifting with recycling of the too fine particles;

FIG. 3*c* shows a sand mold in which a barrier is placed for containing the granules of powder compacted at the location of the reinforcement of the hierarchical composite;

FIG. 3*d* shows an enlargement of the reinforcement area in which the compacted granules comprising the reagents precursor of TiC are located;

step 3*e* shows the casting of the ferrous alloy into the mold;

FIG. 3*f* shows the hierarchical composite which is the result of the casting;

FIG. 3*g* shows an enlargement of the areas with a high concentration of micrometric particles (globules) of TiC—this diagram illustrates the same areas as in FIG. 4;

FIG. 3*h* shows an enlargement within a same area with a high concentration of TiC globules. The micrometric globules are individually surrounded by the cast metal.

FIG. 4 illustrates a binocular view of a polished, non-etched surface of the macro-microstructure according to the invention with millimetric areas (in pale grey) concentrated with micrometric globular titanium carbide (TiC globules). The colors are reversed: the dark portion illustrates the metal matrix (steel or cast iron) filling both the space between these areas concentrated with micrometric globular titanium carbide but also the spaces between the globules themselves (see FIGS. 5 & 6).

FIGS. 5 and 6 illustrate views taken with an SEM electron microscope of micrometric globular titanium carbides on polished and non-etched surfaces at different magnifications. It is seen that in this particular case, most of the titanium carbide globules have a size smaller than 10 μm.

FIGS. 7 and 8 illustrate views of micrometric globular titanium carbides at different magnifications, but this time on fracture surfaces taken with an SEM electron microscope. It is seen that the titanium carbide globules are perfectly incorporated into the metal matrix. This proves that the cast metal infiltrates (impregnates) completely the pores during the casting once the chemical reaction between titanium and carbon is initiated.

FIGS. 9 and 10 are analysis spectra of Ti as well as Fe in a reinforced part according to the invention. This is a <<mapping>> of the distribution of Ti and Fe by EDX analysis, taken with an electron microscope from the fracture surface shown in FIG. 7. The pale spots in FIG. 9 show Ti and the pale spots in FIG. 10 show Fe (therefore the pores filled with the cast metal).

FIG. 11 shows, at a high magnification, a fracture surface taken with an SEM electron microscope with angular titanium carbide which has formed by precipitation, in an area globally free of titanium carbide globules.

Figure 1:
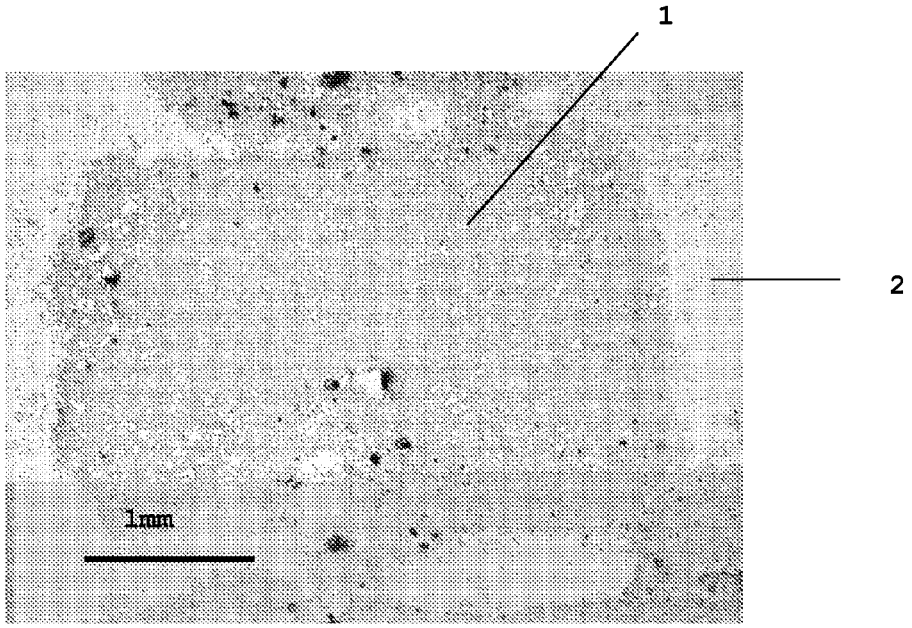
Figure 2:
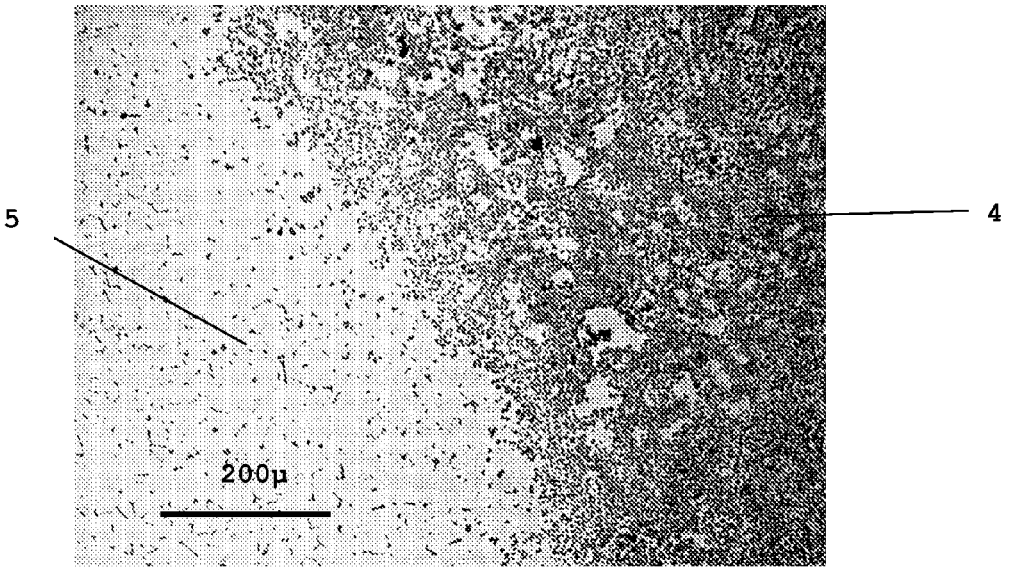

CAPTION 1. millimetric areas concentrated with micrometric globular particles of titanium carbide (globules)
2. millimetric interstices filled with the cast alloy globally free of micrometric globular particles of titanium carbide
3. micrometric interstices between the TiC globules also infiltrated by the cast alloy
4. micrometric globular titanium carbide, in areas concentrated with titanium carbide
5. angular titanium carbide precipitated in the interstices globally free of micrometric globular particles of titanium carbide
6. gas defects
7. anvil
8. mixer of Ti and C powders
9. hopper
10. roll
11. crusher
12. outlet grid
13. sieve
14. recycling of the too fine particles towards the hopper
15. sand mold
16. barrier containing the compacted granules of Ti/C mixture
17. cast ladle
18. hierarchical composite

DETAILED DESCRIPTION OF THE INVENTION

In materials science, a SHS reaction or <<Self-propagating High temperature Synthesis>> is a self-propagating high temperature synthesis where reaction temperatures generally above 1,500° C., or even 2,000° C. are reached. For example, the reaction between titanium powder and carbon powder in order to obtain titanium carbide TiC is strongly exothermic. Only a little energy is needed for locally initiating the reaction. Then, the reaction will spontaneously propagate to the totality of the mixture of the reagents by means of the high temperatures reached. After initiation of the reaction, a reaction front develops which thus propagates spontaneously (self-propagating) and which allows titanium carbide to be obtained from titanium and carbon. The thereby obtained titanium carbide is said to be <<obtained in situ>> because it does not stem from the cast ferrous alloy.

The mixtures of reagent powders comprise carbon powder and titanium powder and are compressed into plates and then crushed in order to obtain granules, the size of which varies from 1 to 12 mm, preferably from 1 to 6 mm, and more preferably from 1.4 to 4 mm. These granules are not 100% compacted. They are generally compressed to between 55 and 95% of the theoretical density. These granules allow an easy use/handling (see FIGS. 3*a*-3*h*).

These millimetric granules of mixed carbon and titanium powders obtained according to the diagrams of FIGS. 3*a*-3*h* form the precursors of the titanium carbide to be generated and allow portions of molds with various or irregular shapes to be easily filled. These granules may be maintained in place in the mold 15 by means of a barrier 16, for example. The shaping or the assembling of these granules may also be achieved with an adhesive.

The hierarchical composite according to the present invention, and in particular the reinforcement macro-microstructure which may further be called an alternating structure of areas concentrated with globular micrometric particles of titanium carbide separated by areas which are practically free of them, is obtained by the reaction in the mold 15 of the granules comprising a mixture of carbon and titanium powders. This reaction is initiated by the casting heat of the cast iron or the steel used for casting the whole part, and therefore both the non-reinforced portion and the reinforced portion (see FIG. 3*e*). Casting therefore triggers an exothermic self-propagating high temperature synthesis of the mixture of carbon and titanium powders compacted as granules (self-propagating high temperature synthesis—SHS) and placed beforehand in the mold 15. The reaction then has the particularity of continuing to propagate as soon as it is initiated.

Figures 3A, 3B, 3C, 3D:
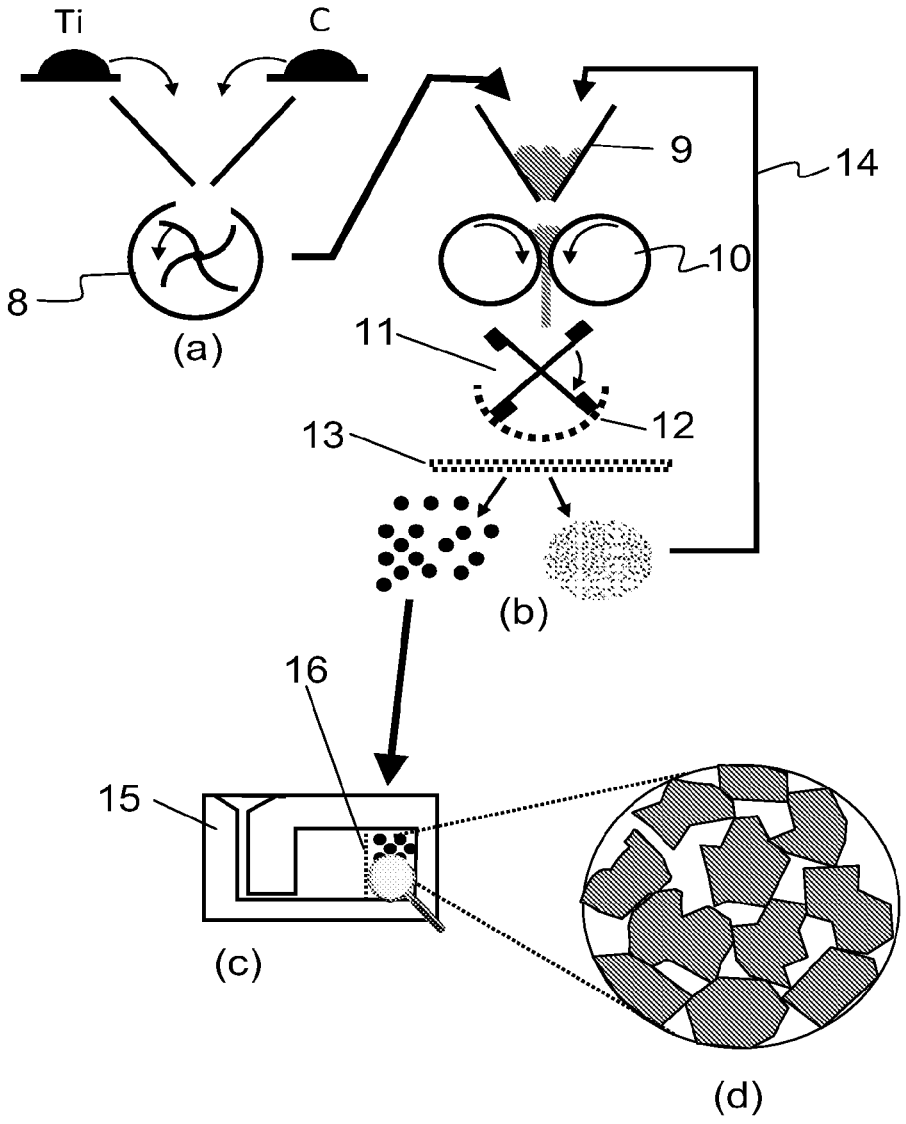
Figures 3E, 3F, 3G, 3H:
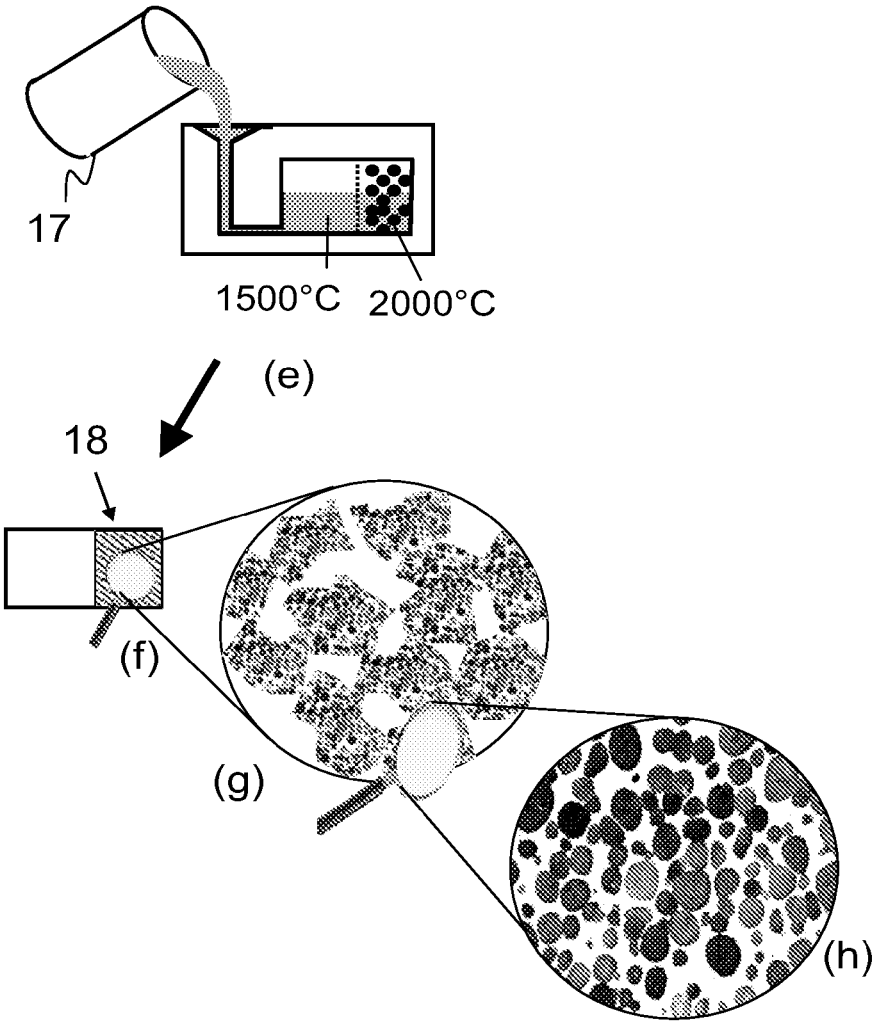

This high temperature synthesis (SHS) allows an easy infiltration of all the millimetric and micrometric interstices by the cast iron or cast steel (FIGS. 3*g* and 3*h*). By increasing the wettability, the infiltration may be achieved over any reinforcement thickness. After SHS reaction and an infiltration by an outer cast metal, it advantageously allows to generate areas with a high concentration of micrometric globular particles of titanium carbide (which may further be called clusters of nodules), said areas having a size of the order of one millimeter or of a few millimeters, and which alternate with areas substantially free of globular titanium carbide. Areas with a low carbide concentration represent in reality the millimetric spaces or interstices 2 between the granules infiltrated by the cast metal. We call this superstructure a reinforcement macro-microstructure.

Once these granules precursor of TiC have reacted according to an SHS reaction, the areas where these granules were located show a concentrated dispersion of micrometric globular particles 4 of TiC (globules), the micrometric interstices 3 of which have also been infiltrated by the cast metal which here is cast iron or steel. It is important to note that the millimetric and micrometric interstices are infiltrated by the same metal matrix as the one which forms the non-reinforced portion of the hierarchical composite, which allows total freedom in the selection of the cast metal. In the finally obtained composite, the reinforcement areas with a high concentration of titanium carbide consist of micrometric globular TiC particles in a significant percentage (between about 35 and 75% by volume) and of the infiltration ferrous alloy.

By micrometric globular particles it is meant globally spheroidal particles which have a size ranging from 1 μm to a few tens of μm at the very most. We also call them TiC globules. The large majority of these particles have a size of less than 50 μm, and even less than 20 μm, or even 10 μm. This globular shape is characteristic of a method for obtaining titanium carbide by self-propagating synthesis SHS (see FIG. 6).

The reinforced structure according to the present invention may be characterized with an optical or electron microscope. The reinforcement macro-microstructure is distinguished therein, visually or with low magnification. At a high magnification, in the areas of high titanium carbide concentration, the titanium carbide with a globular shape 4 is distinguished with a volume percentage in these areas between about 35 and about 75%, depending on the compaction level of the granules which are the cause of these areas (see tables). These globular TiCs are of micrometric size (see FIG. 6).

In the interstices between areas with high titanium carbide concentration, a low percentage of TiC (<5% by volume) with an angular shape 5 formed by precipitation (see FIG. 11) is also seen in some cases. The latter originate from a dissolution in the liquid metal of a small portion of globular carbide, formed during the SHS reaction. The dimension of this angular carbide is also micrometric. The formation of this angular TiC carbide is not desired but is a consequence of the manufacturing method.

In the wear part according to the invention, the volume proportion of TiC reinforcement depends on three factors:

- on the micrometric porosity present in the granules of the mixture of titanium and carbon powders,
- on the millimetric interstices present between the Ti+C granules,
- on the porosity originating from the volume contraction during formation of TiC, from Ti+C.

Mixture for Manufacturing the Granules (Ti+C Version)

The titanium carbide will be obtained by the reaction between carbon powder and titanium powder. Both these powders are mixed homogeneously. The titanium carbide may be obtained by mixing 0.50 to 0.98 moles of carbon to 1 mole of titanium, the stoichiometric composition Ti+0.98 C→$TiC_{0.98}$ being preferred.

Obtaining Granules (Ti+C Version)

The method for obtaining granules is illustrated in FIG. 3*a*-3*h*. The granules of carbon/titanium reagents are obtained by compaction between rolls 10 in order to obtain strips which are then crushed in a crusher 11. The mixing of the powders is carried out in a mixer 8 consisting of a tank provided with blades, in order to favor homogeneity. The mixture then passes into a granulation apparatus through a hopper 9. This machine comprises two rolls 10, through which the material is passed. Pressure is applied on these rolls 10, which allows the compression of the material. At the outlet a strip of compressed material is obtained which is then crushed in order to obtain the granules. These granules are then sifted to the desired grain size in a sieve 13. A significant parameter is the pressure applied on the rolls. The higher this pressure, the more the strip, and therefore the granules, will be compressed. The density of the strips, and therefore of the granules, may thus be varied between 55 and 95% of the theoretical density which is 3.75 g/cm$^3$ for the stoichiometric mixture of titanium and carbon. The apparent density (taking into account porosity) is then located between 2.06 and 3.56 g/cm$^3$.

The compaction level of the strips depends on the applied pressure (in Pa) on the rolls (diameter 200 mm, width 30 mm). For a low compaction level, of the order of $10^6$ Pa, a density on the strips of the order of 55% of the theoretical density is obtained. After passing through the rolls 10 in order to compress this material, the apparent density of the granules is 3.75×0.55, i.e. 2.06 g/cm$^3$.

For a high compaction level, of the order of $25.10^6$ Pa, a density on the strips of 90% of the theoretical density is obtained, i.e. an apparent density of 3.38 g/cm$^3$. In practice, it is possible to attain up to 95% of the theoretical density.

Therefore, the granules obtained from the raw material Ti+C are porous. This porosity varies from 5% for very highly compressed granules to 45% for slightly compressed granules.

In addition to the compaction level, it is also possible to adjust the grain size distribution of the granules as well as their shape during the operation of crushing the strips and sifting the Ti+C granules. The non-desired grain size fractions are recycled at will (see FIG. 3*b*). The obtained granules globally have a size between 1 and 12 mm, preferably between 1 and 6 mm, and more preferably between 1.4 and 4 mm.

Making the Reinforcement Area in the Hierarchical Composite According to the Invention The granules are made as described above. In order to obtain a three-dimensional structure or a superstructure/macro-microstructure with these granules justifying the appellation hierarchical composite, they are positioned in the areas of the mold where it is desired to reinforce the part. This is achieved by agglomerating the granules either by means of an adhesive, or by confining them in a container or by any other means (barrier 16).

The bulk density of the stack of the Ti+C granules is measured according to the ISO 697 standard and depends on the compaction level of the strips, on the grain size distribution of the granules and on the method for crushing the strips, which influences the shape of the granules.

The bulk density of these Ti+C granules is generally of the order of 0.9 g/cm$^3$ to 2.5 g/cm$^3$ depending on the compaction level of these granules and on the density of the stack.

Before reaction, there is therefore a stack of porous granules consisting of a mixture of titanium powder and carbon powder.

During the reaction Ti+C→TiC, a volume contraction of the order of 24% occurs, upon passing from the reagents to the product (a contraction originating from the density difference between the reagents and the products). Thus, the theoretical density of the Ti+C mixture is 3.75 g/cm$^3$ and the theoretical density of TiC is 4.93 g/cm$^3$. In the final product, after the reaction for obtaining TiC, the cast metal will infiltrate:

- the microscopic porosity present in the spaces with a high titanium carbide concentration, depending on the initial compaction level of these granules;
- the millimetric spaces between the areas with a high titanium carbide concentration, depending on the initial stack of the granules (bulk density);
- the porosity originating from the volume contraction during the reaction between Ti+C for obtaining TiC.

EXAMPLES

In the examples which follow, the following raw materials were used:

- titanium H. C. STARCK, Amperit 155.066, less than 200 mesh,
- graphite carbon GK Kropfmuhl, UF4, >99.5%, less than 15 μm,
- Fe, in the form of HSS M2 Steel, less than 25 μm,
- proportions:
  - Ti+C 100 g Ti−24.5 g C
  - Ti+C+Fe 100 g Ti−24.5 g C−35.2 g Fe Mixing for 15 min in a Lindor mixer, under argon.

The granulation was carried out with a Sahut-Conreur granulator.

For the Ti+C+Fe and Ti+C mixtures, the compactness of the granules was obtained in the following way:

| Pressure on the rolls ($10^5$ Pa) | Average compactness (% of theoretical density |
|---|---|
| 10 | 55 |
| 25 | 68 |
| 50 | 75 |
| 100 | 81 |
| 150 | 85 |
| 200 | 88 |
| 250 | 95 |

The reinforcement was carried out by placing granules in a metal container of 100×30×150 mm, which is then placed in the mold at the location of the part to be reinforced. Then, the steel or the cast iron is cast into this mold.

Example 1

In this example, the aim is to make a part, the reinforced areas of which comprise a global volume percentage of TiC of about 42%. For this purpose, a strip is made by compaction to 85% of the theoretical density of a mixture of C and of Ti. After crushing, the granules are sifted so as to obtain a dimension of granules located between 1.4 and 4 mm. A bulk density of the order of 2.1 g/cm$^3$ is obtained (35% of space between the granules+15% of porosity in the granules).

The granules are positioned in the mold at the location of the portion to be reinforced which thus comprises 65% by volume of porous granules. A cast iron with chromium (3% C, 25% Cr) is then cast at about 1500° C. in a non-preheated sand mold. The reaction between the Ti and the C is initiated by the heat of the cast iron. This casting is carried out without any protective atmosphere. After reaction, in the reinforced portion, 65% by volume of areas with a high concentration of about 65% of globular titanium carbide are obtained, i.e. 42% by the global volume of TiC in the reinforced portion of the wear part.

Example 2

In this example, the aim is to make a part, the reinforced areas of which comprise a global volume percentage of TiC of about 30%. For this purpose, a strip is made by compaction to 70% of the theoretical density of a mixture of C and of Ti. After crushing, the granules are sifted so as to obtain a dimension of granules located between 1.4 and 4 mm. A bulk density of the order of 1.4 g/cm$^3$ is obtained (45% of space between the granules+30% of porosity in the granules). The granules are positioned in the portion to be reinforced which thus comprises 55% by volume of porous granules. After reaction, in the reinforced portion, 55% by volume of areas with a high concentration of about 53% of globular titanium carbide are obtained, i.e. about 30% by the global volume of TiC in the reinforced portion of the wear part.

Example 3

In this example, the aim is to make a part, the reinforced areas of which comprise a global volume percentage of TiC of about 20%. For this purpose, a strip is made by compaction to 60% of the theoretical density of a mixture of C and of Ti. After crushing, the granules are sifted so as to obtain a dimension of granules located between 1 and 6 mm. A bulk density of the order of 1.0 g/cm$^3$ is obtained (55% of space between the granules+40% of porosity in the granules). The granules are positioned in the portion to be reinforced which thus comprises 45% by volume of porous granules. After reaction, in the reinforced portion, 45% by volume of areas concentrated to about 45% of globular titanium carbide are obtained, i.e. 20% by the global volume of TiC in the reinforced portion of the wear part.

Example 4

In this example, it was sought to attenuate the intensity of the reaction between the carbon and the titanium by adding a ferrous alloy as a powder therein. Like in Example 2, the aim is to make a wear part, the reinforced areas of which comprise a global volume percentage of TiC of about 30%. For this purpose, a strip is made by compaction to 85% of the theoretical density of a mixture of 15% C, 63% Ti and 22% Fe by weight. After crushing, the granules are sifted so as to attain a dimension of granules located between 1.4 and 4 mm. A bulk density of the order of 2 g/cm$^3$ is obtained (45% of space between the granules+15% of porosity in the granules). The granules are positioned in the portion to be reinforced which thus comprises 55% by volume of porous granules. After reaction, in the reinforced portion, 55% by volume of areas with a high concentration of about 55% of globular titanium carbide are obtained, i.e. 30% by volume of the global titanium carbide in the reinforced macro-microstructure of the wear part.

The following tables show the numerous possible combinations.

TABLE 1

(Ti + 0.98 C)
Global percentage of TiC obtained in the reinforced macro-microstructure after reaction of Ti + 0.98 C in the reinforced portion of the wear part.

| | | Compaction of the granules (% of the theoretical density which is 3.75 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the | 70 | 29.3 | 31.9 | 34.6 | 37.2 | 39.9 | 42.6 | 45.2 | 47.9 | 50.5 |
| reinforced portion | 65 | 27.2 | **29.6** | 32.1 | 34.6 | 37.1 | 39.5 | 42.0 | 44.5 | 46.9 |
| of the part | 55 | 23.0 | 25.1 | 27.2 | **29.3** | 31.4 | 33.4 | 35.5 | 37.6 | 39.7 |
| (% by volume) | 45 | 18.8 | 20.5 | 22.2 | 23.9 | 25.7 | 27.4 | **29.1** | 30.8 | 32.5 |

This table shows that with a compaction level ranging from 55 to 95% for the strips and therefore the granules, it is possible to perform granule filling levels in the reinforced portion ranging from 45% to 70% by volume (ratio between the total volume of the granules and the volume of their confinement). Thus, in order to obtain a global TiC concentration in the reinforced portion of about 29% by volume (in bold characters in the table), it is possible to proceed with different combinations such as for example 60% compaction and 65% filling, or 70% compaction and 55% filling, or further 85% compaction and 45% filling. In order to obtain granule filling levels in the reinforced portion ranging up to 70% by volume, it is mandatory to apply a vibration in order to pack the granules. In this case, the ISO 697 standard for measuring the filling level is no longer applicable and the amount of material in a given volume is measured.

TABLE 2

Relationship between the compaction level, the theoretical density and the TiC percentage obtained after reaction in the granule.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.06 | 2.25 | 2.44 | 2.63 | 2.81 | 3.00 | 3.19 | 3.38 | 3.56 |
| TiC obtained after reaction (and contraction) in volume % in the granules | 41.8 | 45.6 | 49.4 | 53.2 | 57.0 | 60.8 | 64.6 | 68.4 | 72.2 |

Here, we have represented the density of the granules according to their compaction level and the volume percent of TiC obtained after reaction and therefore contraction of about 24% by volume was inferred therefrom. Granules compacted to 95% of their theoretical density therefore allow to obtain after reaction a concentration of 72.2% by volume of TiC.

TABLE 3

Bulk density of the stack of granules

| | | Compaction | | | | | | | | |
|---|---|---|---|---|---|---|---|---|---|---|
| | | 55 | 60 | 65 | 70 | 75 | 80 | 85 | 90 | 95 |
| Filling of the reinforced portion of the part in volume % | 70 | 1.4 | 1.6 | 1.7 | 1.8 | 2 | 2.1 | 2.2 | 2.4 | 2.5 |
| | 65 | 1.3* | 1.5 | 1.6 | 1.7 | 1.8 | 2.0 | 2.1 | 2.2 | 2.3 |
| | 55 | 1.1 | 1.2 | 1.3 | 1.4 | 1.5 | 1.7 | 1.8 | 1.9 | 2.0 |
| | 45 | 0.9 | 1.0 | 1.1 | 1.2 | 1.3 | 1.4 | 1.4 | 1.5 | 1.6 |

*Bulk density (1.3) = theoretical density (3.75 g/cm$^3$) × 0.65 (filling) × 0.55 (compaction)

In practice, these tables are used as abacuses by the user of this technology, who sets a global TiC percentage to be obtained in the reinforced portion of the part and who, depending on this, determines the filling level and the compaction of the granules which he/she will use. The same tables were produced for a mixture of Ti+C+Fe powders.

Ti+0.98 C+Fe

Here, the inventor aimed at a mixture allowing to obtain 15% by volume of iron after reaction. The mixture proportion which was used is:

100 g Ti+24.5 g C+35.2 g Fe

By iron powder it is meant: pure iron or an iron alloy.

Theoretical density of the mixture: 4.25 g/cm$^3$

Volume shrinkage during the reaction: 21%

TABLE 4

Global TiC percentage obtained in the reinforced macro-microstructure after reaction of Ti + 0.98 C + Fe in the reinforced portion of the wear part.

| | | Compaction of the granules (% of the theoretical density which is 4.25 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the reinforced portion of the part (vol. %) | 70 | **25.9** | 28.2 | 30.6 | 32.9 | 35.5 | 37.6 | 40.0 | 42.3 | 44.7 |
| | 65 | 24.0 | **26.2** | 28.4 | 30.6 | 32.7 | 34.9 | 37.1 | 39.3 | 41.5 |
| | 55 | 20.3 | 22.2 | 24.0 | **25.9** | 27.7 | 29.5 | 31.4 | 33.2 | 35.1 |
| | 45 | 16.6 | 18.1 | 19.6 | 21.2 | 22.7 | 24.2 | **25.7** | 27.2 | 28.7 |

Again, in order to obtain a global TiC concentration in the reinforced portion of about 26% by volume (in hold characters in the table), it is possible to proceed with different combinations such as for example 55% compaction and 70% filling, or 60% compaction and 65% filling, or 70% compaction and 55% filling, or further 85% compaction and 45% filling.

TABLE 5

Relationship between the compaction level, the theoretical density and the TiC percentage, obtained after reaction in the granule while taking into account the presence of iron.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.34 | 2.55 | 2.76 | 2.98 | 3.19 | 3.40 | 3.61 | 3.83 | 4.04 |

TABLE 5-continued

| Relationship between the compaction level, the theoretical density and the TiC percentage, obtained after reaction in the granule while taking into account the presence of iron. | | | | | | | | | |
|---|---|---|---|---|---|---|---|---|---|
| | Compaction of the granules | | | | | | | | |
| | 55 | 60 | 65 | 70 | 75 | 80 | 85 | 90 | 95 |
| TiC obtained after reaction (and contraction) in vol. % in the granules | 36.9 | 40.3 | 43.6 | 47.0 | 50.4 | 53.7 | 57.1 | 60.4 | 63.8 |

TABLE 6

| Bulk density of the stack of (Ti + C + Fe) granules | | | | | | | | | | |
|---|---|---|---|---|---|---|---|---|---|---|
| | | Compaction | | | | | | | | |
| | | 55 | 60 | 65 | 70 | 75 | 80 | 85 | 90 | 95 |
| Filling of the reinforced portion of the part in vol. % | 70 | 1.6 | 1.8 | 1.9 | 2.1 | 2.2 | 2.4 | 2.5 | 2.7 | 2.8 |
| | 65 | 1.5* | 1.7 | 1.8 | 1.9 | 2.1 | 2.2 | 2.3 | 2.5 | 2.6 |
| | 55 | 1.3 | 1.4 | 1.5 | 1.6 | 1.8 | 1.9 | 2.0 | 2.1 | 2.2 |
| | 45 | 1.1 | 1.1 | 1.2 | 1.3 | 1.4 | 1.5 | 1.6 | 1.7 | 1.8 |

*Bulk density (1.5) = theoretical density (4.25) × 0.65 (filling) × 0.55 (compaction)

Comparative Test with EP 1 450 973

Figure 13:
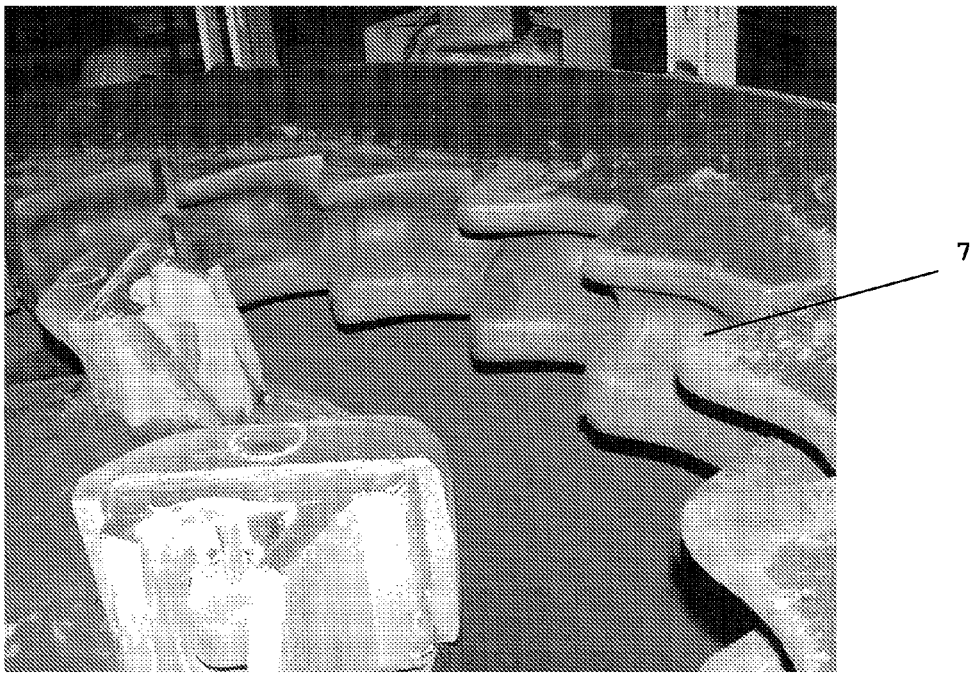
FIG. 13 shows a layout of anvils in a crusher with a vertical axis which was used for carrying out comparative tests between wear parts comprising areas reinforced with bulky inserts and parts comprising areas reinforced with the macro-microstructure of the present invention.
Figure 14:
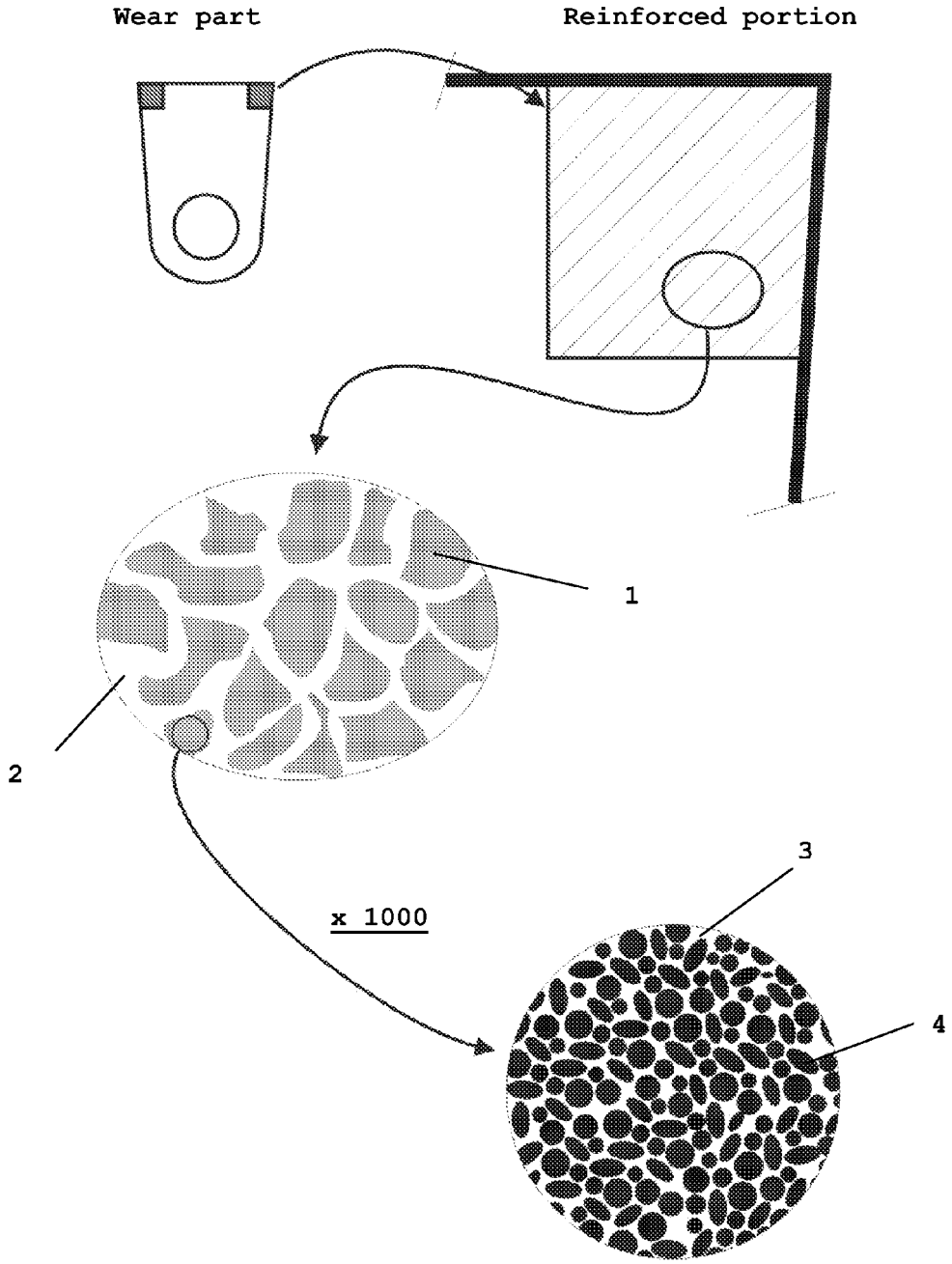
FIG. 14 shows a block diagram illustrating the macro-microstructure according to the present invention already partly illustrated in FIG. 3.

Comparative tests between wear parts comprising areas reinforced with rather bulky inserts (150×100×30 mm) and parts comprising areas reinforced with the macro-microstructure of the present invention were carried out. The milling machine in which these tests were carried out is illustrated in FIG. 13. In this machine, the inventor alternately placed an anvil comprising an insert according to the state of the art surrounded on either side by a non-reinforced anvil, and an anvil with an area reinforced by a macro-microstructure according to the present invention, also surrounded by two non-reinforced reference anvils.

A performance index was defined with respect to a non-reinforce anvil and with respect to a given type of rock. Even if the extrapolation to other types of rock is not always easy, we nevertheless attempted a quantitative approach as to the observed wear.

| Performance index (PI) | | | | | | |
|---|---|---|---|---|---|---|
| | Insert of 150 × 100 × 30 mm (state of the art) | | Reinforced area of 150 × 100 × 30 mm (according to the invention) | | | |
| | | | Granules* | | | Granules* |
| | Ti + C | Ti + C + Fe | Ti + C | | | Ti + C + Fe |
| | (1100 g) | (1240 g) | 630 g | 765 g | 810 g | (900 g) |
| Compaction | 65% | | 70% | 80% | 85% | 85% |
| PI test 1 | 2.1 | | | | 2.5 | |
| PI test 2 | 2.2 | 2.2 | 2.3 | 2.4 | 2.4 | 2.3 |
| PI test 3 | 2.4 | | 2.4 | | 2.7 | |
| PI test 4 | 2.1 | | 2.1 | | 2.4 | |
| PI test 5 | 2.4 | | | 2.4 | | |

*Size of the granules 1.4 and 4 mm

The performance index is the ratio of the wear of the non-reinforced reference anvils with respect to the wear of the reinforced anvil. An index of 2 therefore means that the reinforced part was worn two times slower than the reference parts. The wear is measured in the working portion (worn mm), where the reinforcement is located.

The performances of the insert according to the state of the art are similar to those of the macro-microstructure of the invention, except for the 85% compaction level of the granules which shows a slightly superior performance. If however the amounts of material used for equipping the reinforcement area are compared, it is seen that with 765 g of Ti+C powder, the same performance is obtained as with 1,100 g of Ti+C powder in the form of an insert. Insofar as this mixture costs about 75 Euros/kg in 2008, the advantage provided by the invention is assessed.

Globally, depending on the cases a gain of between 20 and 40% by mass of the reinforcement is achieved by comparison with an insert of the type of those described in EP 1450973. Thus, if a ratio of 4 between the density of the ferrous alloy (±7.6) and the bulk density of the reinforcement (±1.9) is considered, adding 5% by mass of reinforcement corresponds to a reinforcement in the final part of 20% by volume. A very small amount of reinforcement material is therefore positioned in a very effective way.

Advantages

The present invention has the following advantages in comparison with the state of the art in general:

- use of less material for a same reinforcement level;
- better impact resistance;
- equivalent or even better wear resistance;
- more flexibility in the application parameters (more flexibility for the applications);
- less manufacturing defects, in particular
  - less gas defects,
  - less sensitivity to crack during manufacturing,
  - better maintenance of the reinforcement in the part expressed by a lesser waste percentage;
- easy infiltration of the reinforcement because of the exothermicity of the reaction, which allows:
  - to achieve a reinforcement of large thickness,
  - to place the reinforcement at the surface,
  - to reinforce thin walls;
- localized reinforcement, limited to the desired locations;
- sound surface of formed carbide, which entails a good bond with the cast metal;
- no application of pressure during the casting;
- no particular protective atmosphere;
- no compaction post-treatment.

Better Resistance to Impacts

In the method according to the invention, the porous millimetric granules are embedded into the infiltration metal alloy. These millimetric granules themselves consist of microscopic particles of TiC with a globular tendency also embedded into the infiltration metal alloy. This system allows to obtain a composite part with a macrostructure within which there is an identical microstructure at a scale which is about a thousand times smaller.

Figure 4:
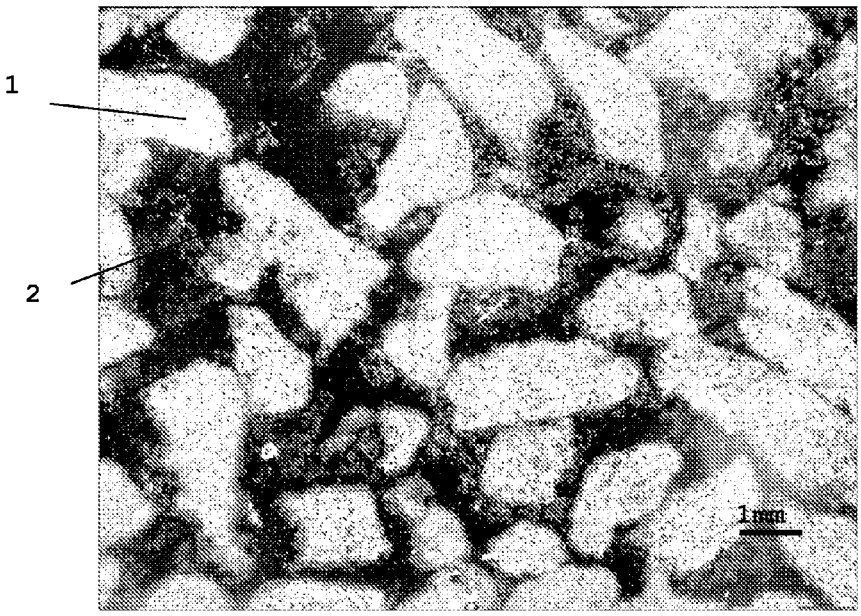
Figure 5:
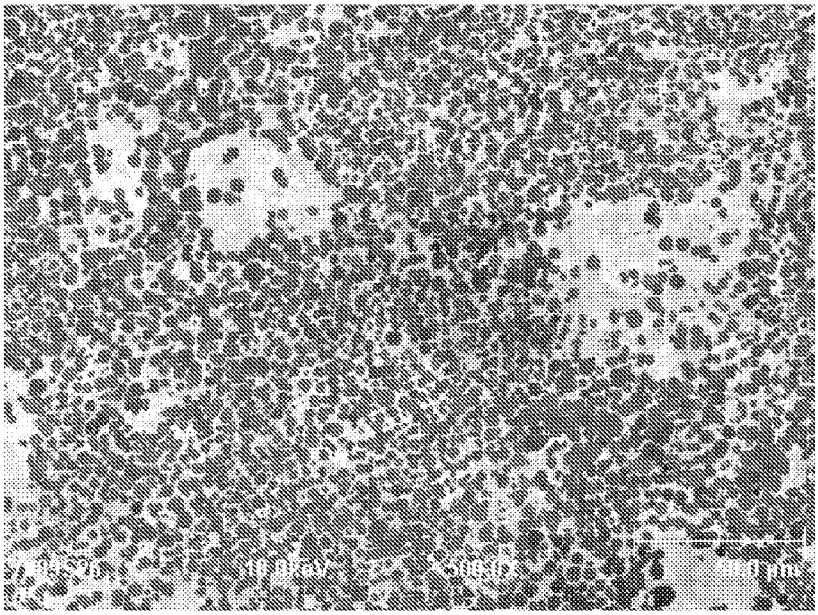
Figure 6:
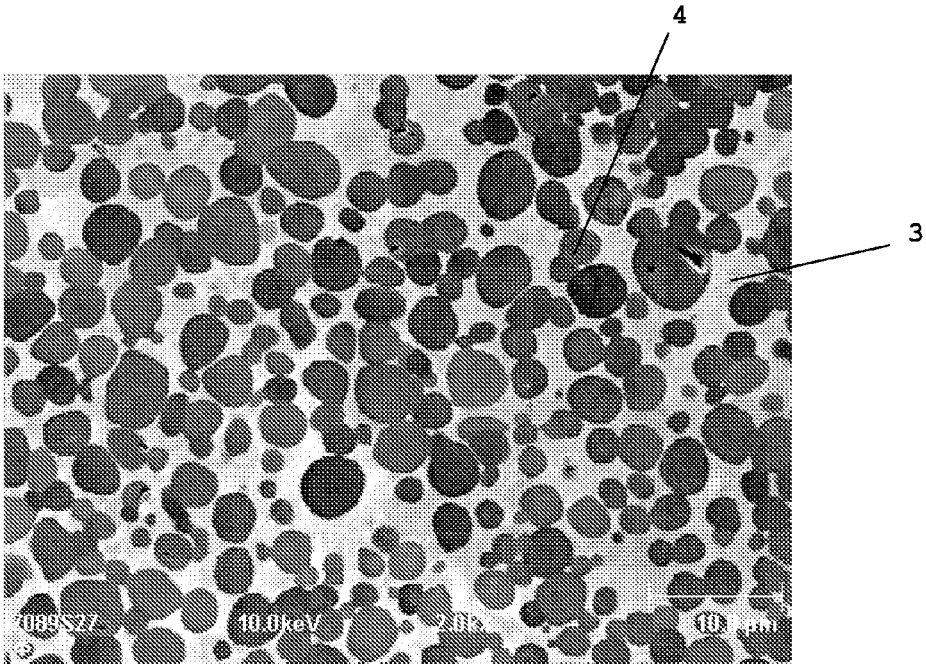
Figure 7:
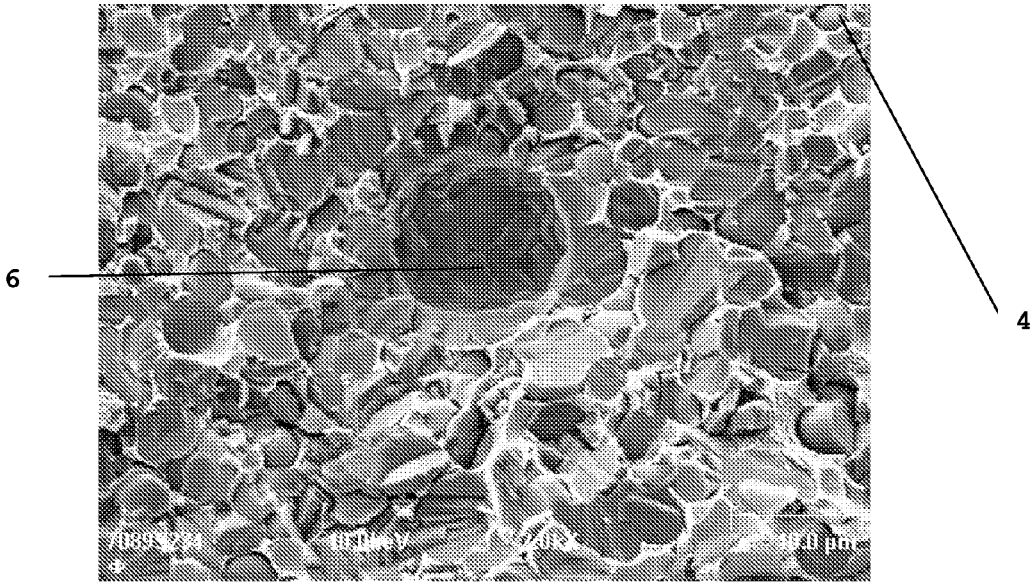

The fact that this material comprises small hard globular particles of titanium carbide finely dispersed in a metal matrix surrounding them allows to avoid the formation and propagation of cracks (see FIGS. 4 and 6). One has thus a double dissipative system for cracks.

The cracks generally originate at the most brittle locations, which in this case are the TiC particle or the interface between this particle and the infiltration metal alloy. If a crack originates at the interface or in the micrometric TiC particle, the propagation of this crack is then hindered by the infiltration alloy which surrounds this particle. The toughness of the infiltration alloy is greater than that of the ceramic TiC particle. The crack needs more energy for passing from one particle to another, for crossing the micrometric spaces which exist between the particles.

Another reason for explaining the better resistance to impacts is a more rational application of titanium carbide for achieving an adequate reinforcement.

Resistance to Wear (Behavior in Use)

It is important to emphasize that this better resistance to impacts is not achieved to the detriment of the resistance to wear. In this technique the hard particles are particularly well integrated into the infiltration metal alloy. In applications subject to violent impacts, a phenomenon of flaking of the reinforced portion is unlikely.

Maximum Flexibility for the Application Parameters

In addition to the compaction level of the granules, two parameters may be varied, which are the grain size fraction and the shape of the granules, and therefore their bulk density. On the other hand, in a reinforcement technique with inserts, only the compaction level of the latter can be varied within a limited range. As regards the desired shape to be given to the reinforcement, taking into account the design of the part and the location where reinforcement is desired, the use of granules allows further possibilities and adaptation.

Advantages as Regards Manufacturing

The use of a stack of porous granules as a reinforcement has certain advantages as regards manufacturing:

less gas emission, less sensitivity to crack, better localization of the reinforcement in the part.

Figure 12:
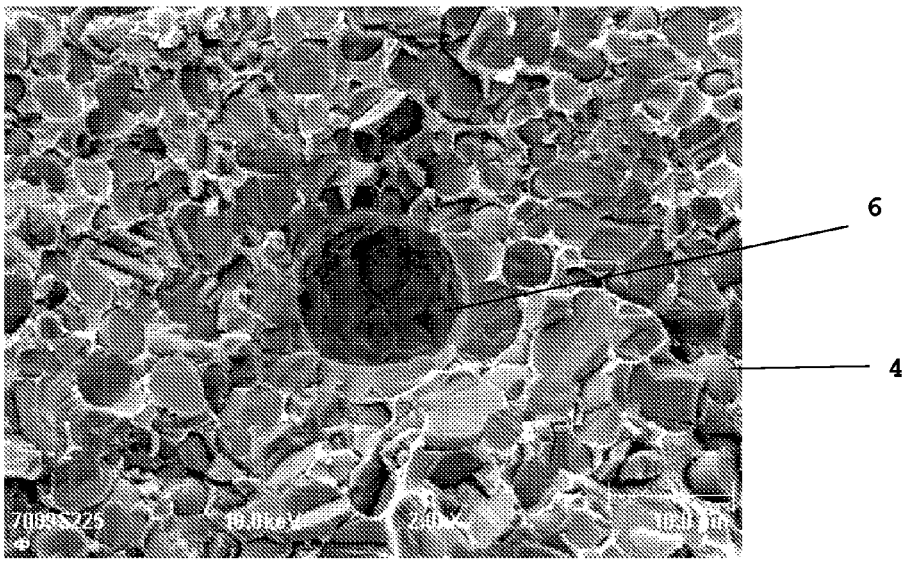
FIG. 12 shows, at a high magnification, a fracture surface taken with an SEM electron microscope with a gas bubble. It is always attempted to limit at most this kind of defect.

The reaction between Ti and C is strongly exothermic. The rise in temperature causes degassing of the reagents, i.e. volatile materials comprised in the reagents ($H_2O$ in carbon, $H_2$, $N_2$ in titanium). The higher the reaction temperature, the more significant is this emission. The granule technique allows to limit the temperature, to limit the gas volume and to more easily discharge the gases and thus limit the gas defects. (see FIG. 12 with an undesirable gas bubble).

Low Sensitivity to Crack During the Manufacturing of the Wear Part According to the Invention The expansion coefficient of the TiC reinforcement is lower than that of the ferrous alloy matrix (expansion coefficient of TiC: 7.5 $10^{-6}$/K and of the ferrous alloy: about 12.0 $10^{-6}$/K). This difference in expansion coefficients has the consequence of generating stresses in the material during the solidification phase and also during the heat treatment. If these stresses are too significant, cracks may appear in the part and lead to its reject. In the present invention a small proportion of TiC reinforcement is used (less than 50% by volume), which causes less stresses in the part. Further, the presence of a more ductile matrix between the micrometric globular TiC particles in the alternating areas of low and high concentration allows to better handle possible local stresses.

Excellent Maintenance of the Reinforcement in the Part

In the present invention, the frontier between the reinforced portion and the non-reinforced portion of the hierarchical composite is not abrupt since there is a continuity of the metal matrix between the reinforced portion and the non-reinforced portion, which allows to protect it against a complete detachment of the reinforcement.

The invention claimed is:

1. A hierarchical composite material comprising a ferrous alloy reinforced with titanium carbides according to a defined geometry, wherein said reinforced portion comprises an alternating macro-microstructure of millimetric areas (1) concentrated with micrometric globular particles of titanium carbide (4) surrounded by millimetric areas (2) essentially free of micrometric globular particles of titanium carbide (4), said areas concentrated with micrometric globular particles of titanium carbide (4) forming a microstructure in which the micrometric interstices (3) between said globular particles (4) are also filled by said ferrous alloy, wherein said millimetric areas concentrated with titanium carbide (1) have a dimension varying from 1 to 12 mm.

2. The composite material according to claim 1, wherein said millimetric concentrated areas have a concentration of titanium carbides (4) greater than 36.9% by volume.

3. The composite material according to claim 1, wherein said reinforced portion has a global titanium carbide content between 16.6 and 50.5% by volume.

4. The composite material according to claim 1, wherein the micrometric globular particles of titanium carbide (4) have a size of less than 50 μm.

5. The composite material according to claim 1, wherein the major portion of the micrometric globular particles of titanium carbide (4) has a size of less than 20 μm.

6. The composite material according to claim 1, wherein said areas concentrated with globular particles of titanium carbide (1) comprise 36.9 to 72.2% by volume of titanium carbide.

7. The composite material according to claim 1, wherein said millimetric areas concentrated in titanium carbide (1) have a dimension varying from 1 to 6 mm.

8. The composite material according to claim 1, wherein said areas concentrated in titanium carbide (1) have a dimension varying from 1.4 to 4 mm.

9. Composite material according to claim 1, wherein said composite is a wear part.

10. A method for manufacturing by casting a hierarchical composite material according to claim 1, comprising the following steps:

providing a mold comprising the imprint of the hierarchical composite material with a predefined reinforcement geometry;

introducing, into the portion of the imprint intended to form the reinforced portion, a mixture of compacted powders comprising carbon and titanium in the form of millimetric granules precursor of titanium carbide;

casting a ferrous alloy into the mold, the heat of said casting triggering an exothermic self-propagating high temperature synthesis (SHS) of titanium carbide within said precursor granules;

forming, within the reinforced portion of the hierarchical composite material, an alternating macro-microstructure of millimetric areas concentrated (1) with micrometric globular particles of titanium carbide (4) at the location of said precursor granules, said areas being separated from each other by millimetric areas (2) essentially free of micrometric globular particles of titanium carbide (4), said globular particles (4) being also separated within said millimetric areas concentrated (1) with titanium carbide by micrometric interstices (3);

infiltration of the millimetric (2) and micrometric (3) interstices by said high temperature cast ferrous alloy, following the formation of microscopic globular particles of titanium carbide (4).

11. The manufacturing method according to claim 10, wherein the mixture of compacted powders of titanium and carbon comprises a powder of a ferrous alloy.

12. The manufacturing method according to claim 10, wherein said carbon is graphite.

13. The hierarchical composite material obtained according to the method of claim 10.

14. A tool or machine comprising a hierarchical composite material according to claim 1.

* * * * *